United States Patent [19]

Mared et al.

[11] Patent Number: 4,479,767

[45] Date of Patent: Oct. 30, 1984

[54] BRIQUETTING PRESSES AND JACK ASSOCIATED WITH SUCH A PRESS

[75] Inventors: Jarl O. Mared, Huskvarna; Elwyn G. Mandley, Tenhult, both of Sweden

[73] Assignee: Ingenjorsfirman J. Mared AB, Huskvarna, Sweden

[21] Appl. No.: 417,549

[22] Filed: Sep. 13, 1982

[30] Foreign Application Priority Data

Sep. 28, 1981 [SE] Sweden ..... 8105709

[51] Int. Cl.[3] ..... B30B 11/22

[52] U.S. Cl. ..... 425/186; 425/193

[58] Field of Search ..... 425/78, 182, 186, 190, 425/193, 579, 554, 556, 569, 575, 183, 466

[56] References Cited

U.S. PATENT DOCUMENTS

| | | | |
|---|---|---|---|
| 1,819,277 | 8/1931 | Carpenter | 425/579 |
| 1,911,019 | 5/1933 | Grafenstatt et al. | 425/556 |
| 2,384,163 | 9/1945 | Flowers | 425/556 |
| 3,594,869 | 7/1971 | Sher | 425/556 |
| 3,596,326 | 8/1971 | Annis et al. | 425/569 |
| 3,989,433 | 11/1976 | Furman | 425/466 |
| 4,361,530 | 11/1982 | Peer | 425/381 |
| 4,412,806 | 11/1983 | Gaiser et al. | 425/554 |

FOREIGN PATENT DOCUMENTS

| | | | |
|---|---|---|---|
| 140622 | 3/1980 | Fed. Rep. of Germany | 425/556 |

*Primary Examiner*—Jay H. Woo

*Assistant Examiner*—Tinker R. McBrayer

*Attorney, Agent, or Firm*—Hubbell, Cohen, Stiefel & Gross

[57] ABSTRACT

An improvement in briquetting presses and the like comprises a wear ring, a press cone, an end tube and a press cylinder which is diametrically slotted and encloses the press cone and the end tube, said parts being secured to a machine frame. To facilitate the dismounting of the abovementioned parts the press cylinder is suspended in a pair of brackets which project from the machine frame in such a way that the press cylinder together with the press cone and the end tube is displaceable away from the machine frame and after such displacement is rotatable on an axis which is substantially perpendicular to the central axis of the press cone and the end tube. A hydraulic jack associated with the press and designed to cooperate with the press cylinder comprises a yoke and a bail which together enclose the press cylinder at the compression of its two slots. To permit the jack to be utilized for pressing out the press cone and the end tube of the press cylinder, the yoke and the bail are rotatable at least about 90° mutually on an axis which at the compression of the slots is located substantially in one of the diametral planes of the press cylinder, and in addition hereto the jack is provided with engagement means cooperating with abutment or holding on means which are provided on the press cylinder.

10 Claims, 5 Drawing Figures

BRIQUETTING PRESSES AND JACK ASSOCIATED WITH SUCH A PRESS

BACKGROUND OF THE INVENTION

Due to the fuel situation existing at present in large parts of the world waste of different kinds, particularly wood waste and other cellulosic materials have gained an ever increasing importance. An economically advantageous way of working up such granular and/or powdery waste material, e.g. wood waste of different kinds, especially bark, saw-dust, grinding dust, waste from cutting and clean-cutting, and peanut shells, sun flower husks, sugar cane bagasse, hazelnut shells, and so on, comprises pressing of the material into briquettes in a briquetting press.

This invention relates to an improvement in such presses, particularly for briquettes and the like, which is generally defined in the preamble of claim 1. The invention also relates to a jack of the kind generally associated with such briquetting presses and defined in the preamble of claim 8.

Briquetting presses of the kind in question mostly are heavy and expensive machines comprised in large and cost-demanding plants. While such presses produce a high quality product, it is important that the total annual time of utilization and the total annual idle machine time is made as long as possible and as short as possible, respectively.

Hitherto dismounting of briquetting presses generally has been carried out by first removing the unit comprised of the press cylinder, the press cone and the end tube from the frame and subsequently disengaging the end tube and the press cone from the press cylinder. This disengagement has been effected either by hammering with a sledge upon that end of the end tube which projects outside the press cylinder, or by transporting the unit to a workshop where a press is available by which it is possible to press (instead of hammering) out the press cone of the press cylinder. These known methods are time consuming.

SUMMARY OF THE INVENTION

With regard to the above circumstances it is a primary object of the invention to reduce the annular idle machine time of briquetting and similar presses by simplifying the exchange of wear ring and/or press cone and/or end tube and thus reducing the time necessary for each repair.

This object is attained thanks to the fact that the machine and the jack according to the invention are so designed as is set forth in the characterizing clause of claims 1 and 8, respectively.

BRIEF DESCRIPTION OF THE DRAWINGS

Further features and advantages of the improvement according to the invention will become apparent from the following detailed description and the annexed drawings, which diagrammatically and as non-limiting example illustrate a preferred embodiment of the invention, and in which.

DESCRIPTION OF THE PREFERRED EMBODIMENT

Figure 1:
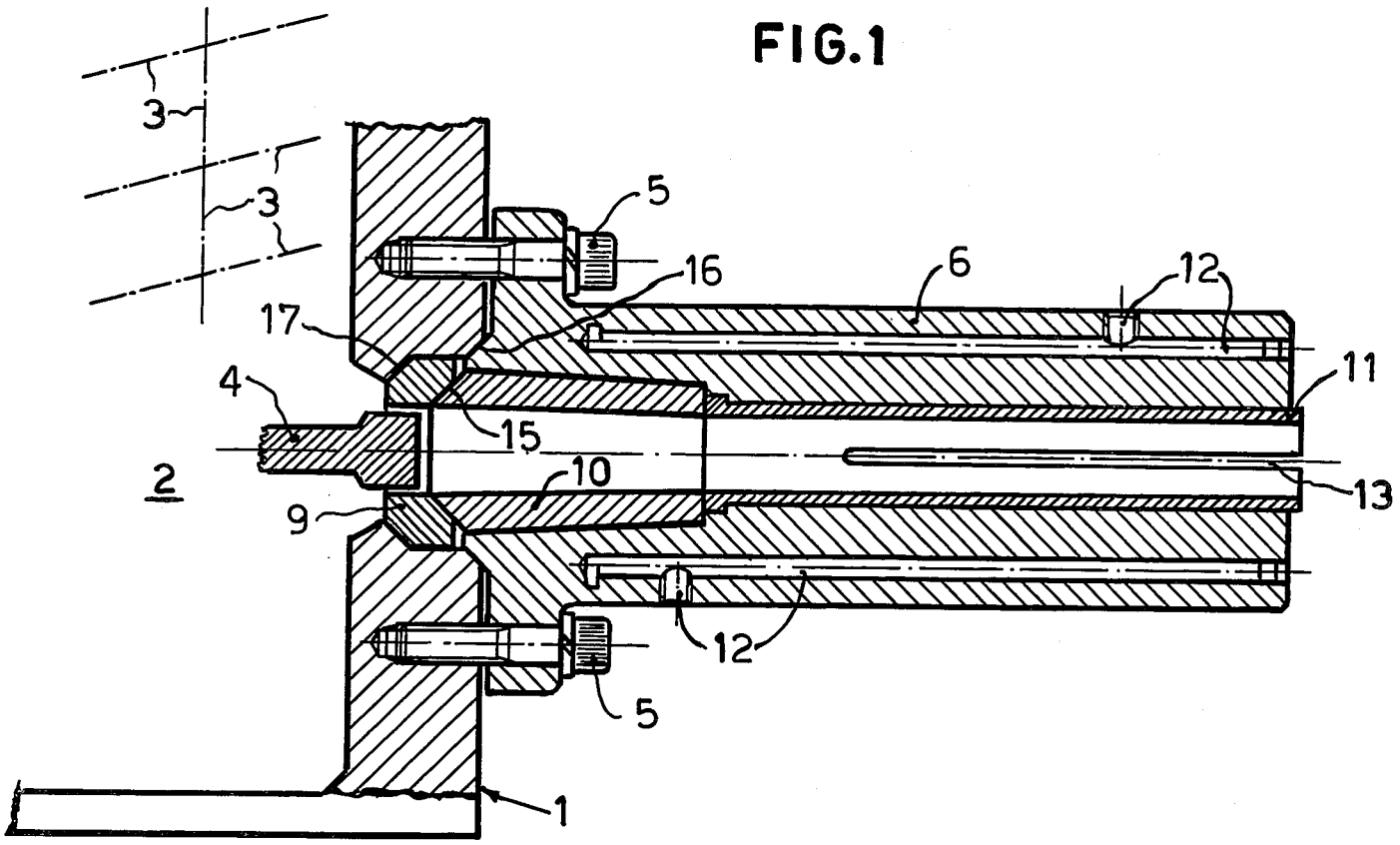
FIG. 1 is a horizontal section on line C—C in FIG. 2 and illustrates some of the briquetting press parts involved in the invention.
Figure 2:
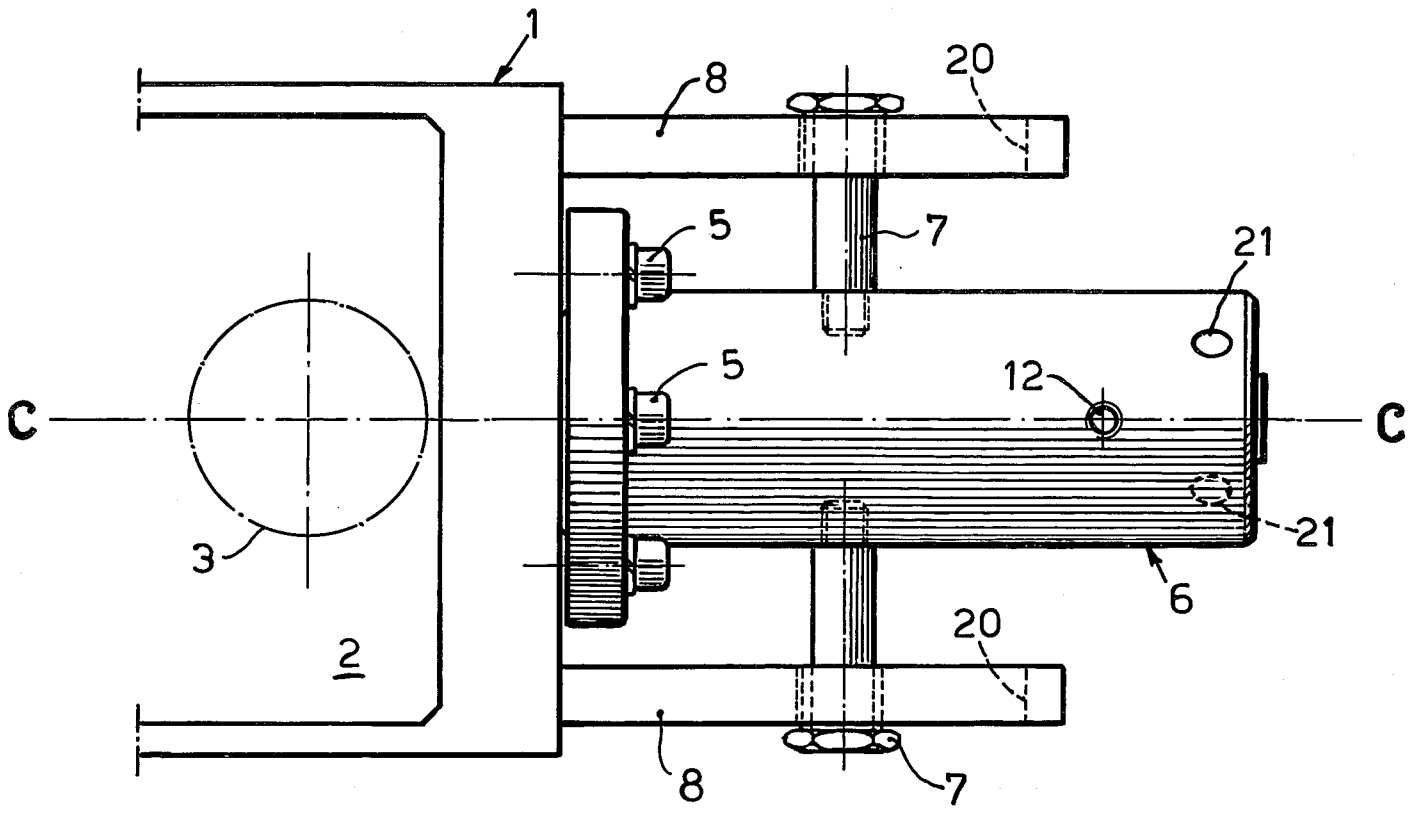
FIG. 2 is a plan view corresponding to FIG. 1.

In the Figures of the drawings, which are not drawn on the same scale, 1 designates a machine frame having a shaft 2 and an feed screw 3 only diagrammatically indicated and by means of which the press material is advanced to its pressing position. By way of example, in the briquetting press, the the material comprises wood chips or another cellulosic material or the like. A press piston 4 which is provided in the shaft 2 and only shown in FIG. 1 is reciprocatable coaxially with the axis C—C.

A press cylinder 6 which suitably is provided with cooling ducts 12 is secured to the machine frame 1 by means of bolts 5. To the machine frame 1 there is also attached a wear ring 9 (FIG. 1) which is coaxial with the central axis C—C and with which the piston 3 cooperates. Coaxially with the axis C—C and in the direction to the right, away from the piston 3, the wear ring 9 is followed by a press cone 10 and a wear or end tube 11 in the order mentioned. The two last mentioned units are tightly enclosed by the press cylinder 6. The press cone 10 which is defined by (truncated) conical circumferential surfaces externally as well as internally abuts at its mutually opposite ends tightly against the wear ring 9 and the end tube 11, respectively. The end tube, like the press cylinder 6, partly slotted in a diametrical plane, as is shown at 13, for reasons which will become apparent from the following.

Figure 3:
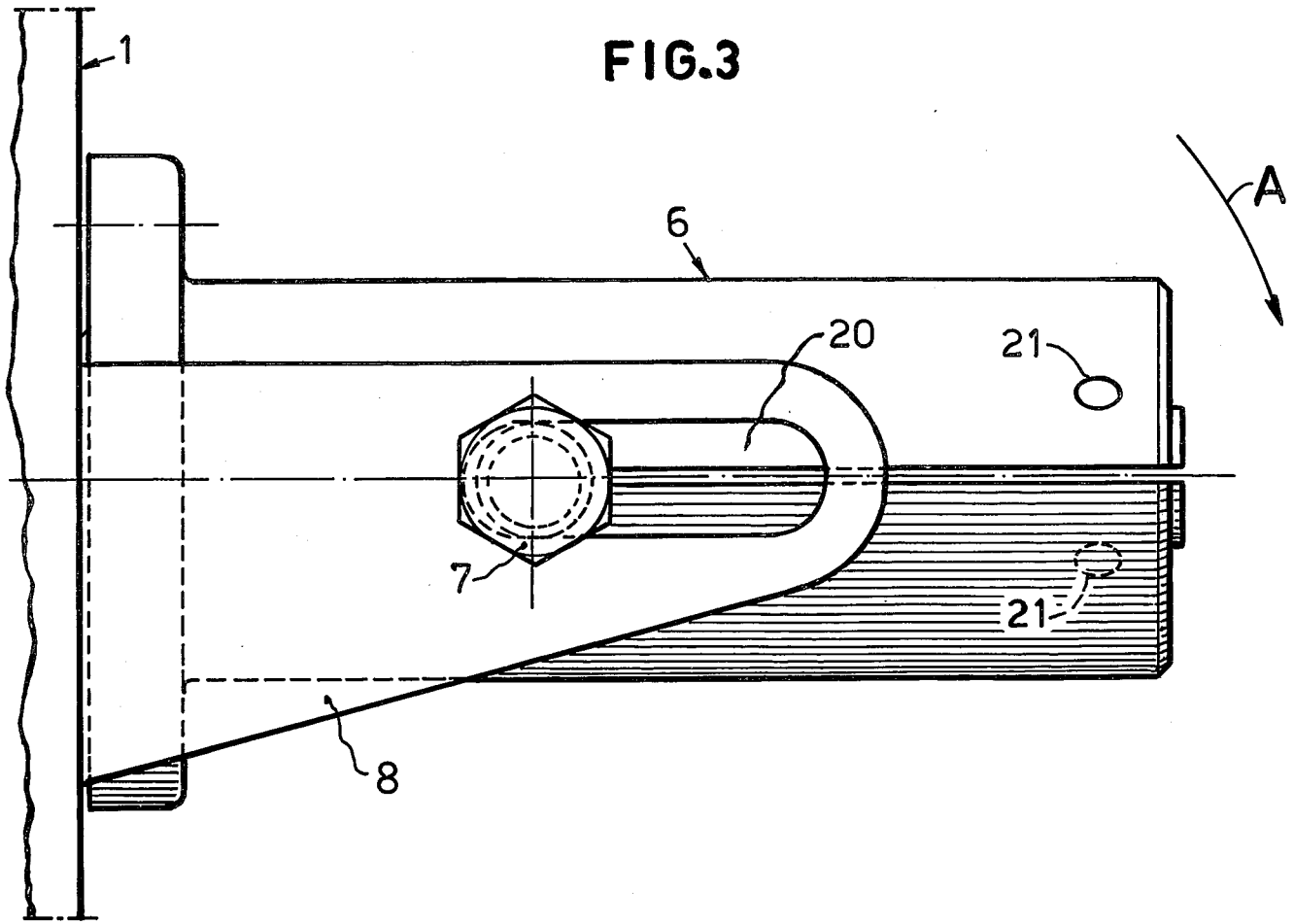
FIG. 3 is a partial side view illustrating one of the brackets in which the press cylinder is suspended.

According to the invention the press cylinder 6 in addition hereto is suspended by means of bolts 7 in a pair of brackets 8 (FIG. 3) projecting from the frame 1 in such a way that the press cylinder 6 together with the press cone 10 and the end tube 11 after loosening of the bolts 5 may be displaced in the long slots 20 provided in the brackets 8 and subsequently be rotated at least 90° in the direction of the arrow A in FIG. 3 with the common central axis of the bolts 7 as its axis of rotation.

In accordance with a further feature of the invention there are provided in the circumferential surface of the press cylinder 6 two dead end holes 21 which are located substantially in a common dimetral plane which is angularly displaced with respect to the diametral plane in which the slots 13 are located to prevent the dead end holes 21 from interfering with the slots 13 (or cooling ducts 12 shown in FIG. 1).

Figure 4:
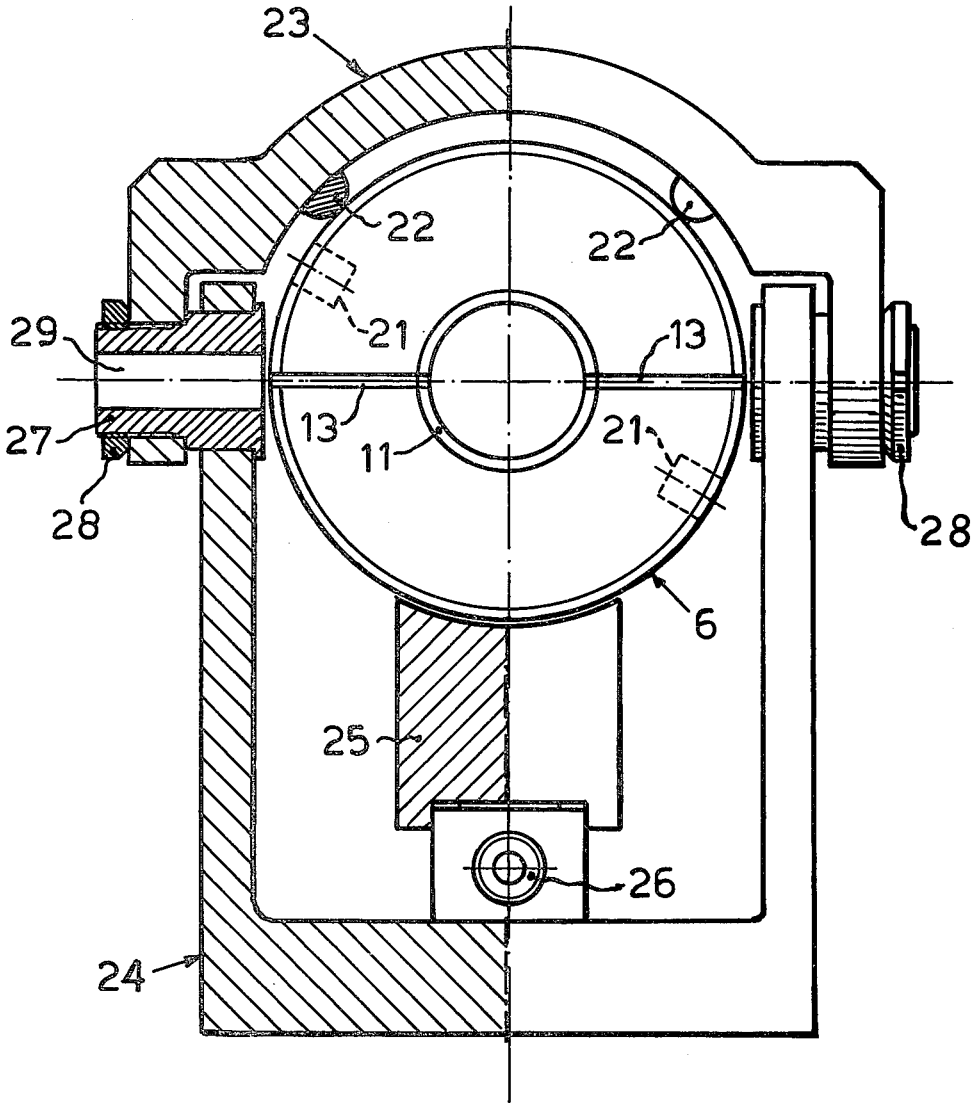
FIG. 4 partly in a vertical section (the left-hand portion) and partly in an end view (the right-hand portion) illustrates a hydraulic jack associated with the press cylinder.
Figure 5:
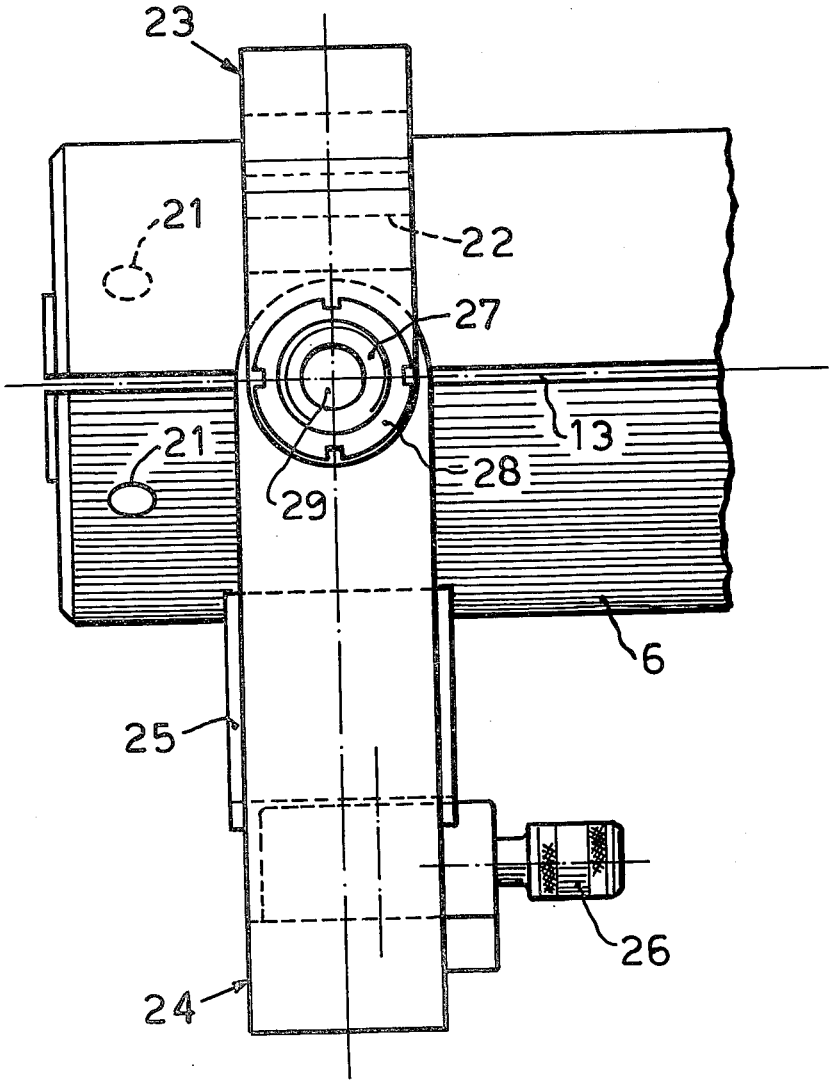
FIG. 5 is a partial side view corresponding to FIG. 4.

The slots 13 have for their object to make possible an increase or a decrease in the conicity or taper of the end tube 11 and the press cylinder 6 in cooperation with a pusher means such as a hydraulic jack or ram as shown in FIGS. 4 and 5 by compressing and widening, respectively, of the slots 13 by means of the jack.

The jack according to the invention comprises, in a manner known per se, a yoke 23 and a bail 24 which enclose the press cylinder 6 during the (briquette) pressing operation. On that side of the yoke 23 which faces the inside of the press cylinder the yoke is provided with a pair of half-cylindrical ridges 22 (FIG. 4) which extend in the axial direction of the press cylinder and engage the circumferential surface of the press cylinder along a respective generatrix. The bail 24 is provided with a press block 25 and an inlet 26 for a pressure fluid by means of which the block 25 can be readily pressed against the circumferential surface of the press cylinder 6 in a direction which is perpendicular to the diametral plane defined by the slots 13 and bisects the center angle between those generatrices which are engaged by the ridges 22.

In accordance with an essential feature of the invention, the yoke 23 and the bail 24 are pivotably or rotatably interconnected.

Preferably, the pivot axis is located in the diametral plane defined by the slots 13 and is generally perpendicular to the longitudinal axis of the press cylinder 6. According to a further development of the invention the hinge joint is constituted by a pair of mutually coaxial tubular pins 27 which are each secured to the yoke 23 by a nut 28 and have each a through, central opening 29.

In other presses , it is unavoidable that the wear ring 9 and/or the press cone 10 and/or the end tube 11 is broken or worn and has to be replaced for other reasons. The press according to this invention has its greatest importance in connection with a partial dismounting which is necessary in connection with such a replacement.

According to the invention the removal of end tube and press cone whereby also the wear ring 9 becomes accessible is carried out in the following way:

Firstly, pressure fluid is evacuated from the jack, which is presumed to be attached to the press cylinder 6 according to FIGS. 4 and 5, through the inlet/outlet 26, so that the pressure from the jack against the press cylinder disappears, after which the press block 25 is removed. Subsequently, the jack is displaced along the central axis C—C of the press cylinder 6, until the pivot axis of the tubular pins 27 becomes located in the plane which contains the dead end holes 21 and is perpendicular to the axis C—C. Subsequently the fastening bolts 5 are unscrewed, after which the press cylinder together with the press cone 10 and the end tube 11 is displaced as one unit in the longitudinal slots 20 of the brackets (together with the jack). Subsequently, the jack is rotated on the central axis C—C until the tubular pins 27 become coaxial with the dead end holes 21, after which the jack is anchored in the press cylinder by means of pins or bolts (not shown) which are inserted in the dead end holes 21 through the tubular pins 27. In the next step the press cylinder 6, the press cone 10, the end tube 11 and the yoke 23 of the jack are rotated as one unit 90° on the common longitudinal axis of the bolts 7, so that the axis C—C becomes vertical, the bail 24 thereby returning to its vertical position. After that a block (not shown) having an end or press surface which is conformed to the free end of the end tube is inserted as a substitute or replacement for the press block 25 between the end tube 11 and the bail 24. As the last step the end tube 11 and the press cone 10 are pressed out of the press cylinder 6 by supplying pressure fluid to the jack through the inlet 26. Now, the wear ring (FIG. 1) also becomes accessible, so that it can be withdrawn out of the machine frame 1.

Of course, the embodiment described above and illustrated in the drawings is to be regarded merely as a nonlimiting example and may as to its details be modified in several ways within the scope of the following claims. In particular, the dead end holes 21 constituting abutment or holding on means may be substituted by studs or by a ring flange which is divided just opposite the slots 13 and project from the circumferential surface of the press cylinder. Furthermore, the dismounting operations may be carried out in another sequence than that described above. Finally, the invention may be applied to other presses than briquetting presses.

What we claim is:

1. A briquetting press comprising a machine frame, a wear ring, a press cone, an end tube and a press cylinder surrounding the press cone, fastening means for securing the end tube to said machine frame substantially co-axially therewith, wherein the press comprises suspension means including a pair of brackets projecting from the machine frame, the press cylinder being suspended so that said press cylinder is displaceable away from the machine frame together with the press cone and the end tube.

2. The briquetting press according to claim 1, wherein said press cylinder, after said press cylinder's displacement away from the machine frame, is rotatable about 90° on an axis which is substantially perpendicular to the longitudinal axis of the press cone and the end tube.

3. The briquetting press according to claim 2, wherein said brackets have a pair of elongated openings in which a pair of bolts or studs projecting from the press cylinder are engaged.

4. The briquetting press according to claim 2, wherein the press cylinder and the end tube at their respective ends remote from the machine frame are each provided with a pair of radially extending through slots located substantially in a common diametral plane, and further comprising pushing means for compressing said slots, characterized by abutment means provided on the circumferential surface of said press cylinder for absorbing forces directed substantially in the axial direction of the press cylinder, said pushing means being engageable with said abutment means for pressing the press cone and the end tube out of the press cylinder through the end of the press cylinder remote from the slots after rotation of the press cylinder on the press cylinder's axis of rotation.

5. The briquetting press according to claim 4, wherein said abutment means are a pair of dead end holes provided substantially diametrically with respect to the longitudinal axis of the press cylinder in the circumferential surface of the press cylinder.

6. The briquetting press according to claim 4, wherein said abutment means are a pair of mutually coaxial studs which project from the circumferential surface of the press cylinder and are diametrically located with respect to the longitudinal axis of the press cylinder.

7. The briquetting press according to claim 5, wherein said dead end holes are located in another diametral plane than are the slots of the press cylinder.

8. Pushing means particularly for cooperation with briquetting presses of the type including a press cylinder having two substantially diametrically located compressable slots, said pushing means comprising a yoke and a bail, which together enclose said press cylinder upon the compression of said two slots, and a press block associated with the bail and being abuttable against that portion of the press cylinder which at the compression of the slots is located on the opposite side of the slots with respect to the yoke, wherein said yoke and said bail are mutually rotatable at least about 90° on an axis which, at the compression of the slots, is located substantially in one of the diametral planes of the press cylinder, said pushing means including engagement means for engaging said abutment means provided on said press cylinder.

9. Pusher means according to claim 8, wherein said bail is pivotably connected to said yoke by tubular pins, said engagement means comprising a pair of studs and a pair of dead end holes in the circumferential surface of said press cylinder, said tubular pins being insertable in said dead end holes.

10. Pusher means according to claim 8, wherein said press block is provided with a concave end surface with substantially the same curvature as the circumferential surface of said press cylinder, said concave end surface being interchangeably positioned against a press block having an end surface specially designed for abutment against the end surface of said end tube.

* * * * *